US011091968B2

(12) United States Patent
Astudillo et al.

(10) Patent No.: US 11,091,968 B2
(45) Date of Patent: Aug. 17, 2021

(54) AUTOMATED CHOKE CONTROL APPARATUS AND METHODS

(71) Applicant: Schlumberger Technology Corporation, Sugar Land, TX (US)

(72) Inventors: Luis Astudillo, Dubai (AE); Tiago Albrecht de Freitas, Udhailiyah (SA); Henrique Duarte Moser, Neuquen (AR); Wasim Azem, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 155 days.

(21) Appl. No.: 16/492,742

(22) PCT Filed: Mar. 12, 2018

(86) PCT No.: PCT/US2018/021913
§ 371 (c)(1),
(2) Date: Sep. 10, 2019

(87) PCT Pub. No.: WO2018/165643
PCT Pub. Date: Sep. 13, 2018

(65) Prior Publication Data

US 2020/0325742 A1 Oct. 15, 2020

Related U.S. Application Data

(60) Provisional application No. 62/469,827, filed on Mar. 10, 2017.

(51) Int. Cl.
*E21B 34/02* (2006.01)
*E21B 34/16* (2006.01)
(Continued)

(52) U.S. Cl.
CPC ..... *E21B 21/08* (2013.01); *E21B 21/106* (2013.01); *E21B 34/025* (2020.05); *E21B 47/06* (2013.01); *E21B 34/16* (2013.01)

(58) Field of Classification Search
CPC ..... E21B 34/025; E21B 34/16
See application file for complete search history.

(56) References Cited

U.S. PATENT DOCUMENTS 4,630,675 A 12/1986 Neipling et al.
6,595,294 B1 * 7/2003 Dalsmo ..... E21B 43/122 166/250.01

(Continued)

FOREIGN PATENT DOCUMENTS

WO 2014007797 A1 1/2014

OTHER PUBLICATIONS

Extended Search Report issued in the EP Application 18764140.2, dated Nov. 4, 2020 (7 pages).

(Continued)

*Primary Examiner* — Shane Bomar
(74) *Attorney, Agent, or Firm* — Cameron R. Sneddon

(57) ABSTRACT

Automated choke control apparatus and methods are disclosed herein. An apparatus for automatically controlling a choke valve comprises a controller. The controller is to control a choke position of the choke valve via a first control loop in response to selection of a first one of a plurality of operation modes being detected. The controller is further to control a wellhead pressure of a wellhead via a second control loop in response to selection of a second one of the plurality of operation modes being detected, the wellhead being operatively coupled to the choke valve.

20 Claims, 5 Drawing Sheets

(51) Int. Cl.

| | |
|---|---|
| ***E21B 21/08*** | (2006.01) |
| ***E21B 21/10*** | (2006.01) |
| ***E21B 47/06*** | (2012.01) |

(56) References Cited

U.S. PATENT DOCUMENTS

| | | | | |
|---|---|---|---|---|
| 2004/0144565 | A1 | 7/2004 | Koederitz | |
| 2004/0216884 | A1 | 11/2004 | Bodine et al. | |
| 2005/0092523 | A1 | 5/2005 | McCaskill et al. | |
| 2005/0222772 | A1 | 10/2005 | Koederitz et al. | |
| 2008/0154510 | A1 | 6/2008 | Scott | |
| 2010/0307598 | A1* | 12/2010 | Cao | B01D 19/0063 137/2 |
| 2012/0215364 | A1* | 8/2012 | Rossi | E21B 43/121 700/281 |
| 2012/0255776 | A1* | 10/2012 | Knudsen | E21B 44/00 175/25 |
| 2014/0090888 | A1 | 4/2014 | Smith et al. | |
| 2015/0083494 | A1* | 3/2015 | Noske | E21B 21/10 175/48 |
| 2015/0292291 | A1* | 10/2015 | Donald | E21B 49/08 166/368 |
| 2015/0337218 | A1* | 11/2015 | Ricotta | E21B 43/00 208/187 |
| 2016/0298401 | A1 | 10/2016 | Cotten et al. | |
| 2017/0175731 | A1* | 6/2017 | Abrol | F04D 13/086 |
| 2018/0135365 | A1* | 5/2018 | Knudsen | E21B 21/08 |
| 2018/0274347 | A1* | 9/2018 | Ricotta | C10G 33/06 |

OTHER PUBLICATIONS

International Preliminary Report on Patentability issued in the related PCT Application PCT/US2018/021913, dated Sep. 19, 2019 (14 pages).

International Search Report and Written Opinion issued in the related PCT Application PCT/US2018/021913, dated Jun. 26, 2018 (15 pages).

* cited by examiner

AUTOMATED CHOKE CONTROL APPARATUS AND METHODS

BACKGROUND

This disclosure relates generally to choke control and, more specifically, to automated choke control apparatus and methods.

DESCRIPTION OF THE RELATED ART

Choke valves are commonly implemented in connection with drilling operations (e.g., underbalanced drilling, overbalanced drilling, etc.) to control the wellhead pressure (e.g., the surface pressure) of a wellhead operatively coupled to a production well. Conventional choke control systems include control panels having a wellhead pressure indicator and a choke position indicator that respectively provide a human drilling operator with corresponding visual indications of the wellhead pressure of the wellhead and the choke position of the choke valve. As used herein, the term "choke position" means an extent to which a flow control member (e.g., a plug) of a choke valve is open and/or closed relative to a fully-open and/or fully-closed position of the flow control member. The choke position of a choke valve may be expressed as a percentage of a maximum stroke distance traveled by the flow control member of the choke valve and/or by a maximum stroke distance traveled by a stem rigidly coupled (e.g., directly or indirectly) to the flow control member of the choke valve.

The control panels of the conventional choke control systems described above further include a manually-operable control lever that is movable and/or positionable by the drilling operator. In response to noticing an undesirable wellhead pressure via the wellhead pressure indicator, and/or in response to noticing an undesirable choke position via the choke position indicator, the drilling operator may move and/or adjust a position of the manually-operable control lever to reduce the extent to which the wellhead pressure of the wellhead and/or the choke position of the choke valve deviate from desired value(s). The drilling operator may need to adjust the manually-operable control lever frequently to maintain the wellhead pressure and/or the choke position of the choke valve at desired value(s).

SUMMARY

Automated choke control apparatus and methods are disclosed herein. In some examples, an apparatus for automatically controlling a choke valve is disclosed. In some examples, the apparatus includes a controller. In some examples, the controller is to control a choke position of the choke valve via a first control loop in response to selection of a first one of a plurality of operation modes being detected. In some examples, the controller is to control a wellhead pressure of a wellhead via a second control loop in response to selection of a second one of the plurality of operation modes being detected, the wellhead being operatively coupled to the choke valve.

In some examples, a method for automatically controlling a choke valve is disclosed. In some examples, the method includes controlling a choke position of the choke valve via a first control loop in response to selection of a first one of a plurality of operation modes being detected. In some examples, the method includes controlling a wellhead pressure of a wellhead via a second control loop in response to selection of a second one of the plurality of operation modes being detected, the wellhead being operatively coupled to the choke valve.

In some examples, a tangible machine readable storage medium including instructions is disclosed. In some examples, the instructions, when executed, cause a controller to control a choke position of a choke valve via a first control loop in response to selection of a first one of a plurality of operation modes being detected. In some examples, the instructions, when executed, cause the controller to control a wellhead pressure of a wellhead via a second control loop in response to selection of a second one of the plurality of operation modes being detected, the wellhead being operatively coupled to the choke valve.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness.

DETAILED DESCRIPTION

Well pressure control is critical to successfully performing drilling operations (e.g., underbalanced drilling, overbalanced drilling, etc.). Conventional choke control systems and/or the control panels thereof require that a human drilling operator make regular (e.g., frequent) adjustments to a manually-operated control lever to maintain a wellhead pressure of a wellhead and/or a choke position of a choke valve at desirable value(s). Unlike such conventional choke control systems and/or control panels, the automated choke control apparatus and methods disclosed herein selectively control the wellhead pressure of the wellhead via a wellhead pressure control loop, or the choke position of the choke valve via a choke position control loop. Implementation of the disclosed automated choke control apparatus and methods advantageously reduces the extent of human intervention needed to maintain a wellhead pressure of a wellhead and/or a choke position of a choke valve at desirable value(s). Reducing the extent of human intervention reduces the possibility of human exposure to a well scenario (e.g., a blowout) and also reduces operational risks associated with human errors. Before describing the details of example automated choke control apparatus and methods, a description of a known choke control system is provided in connection with FIG. 1.

Figure 1:
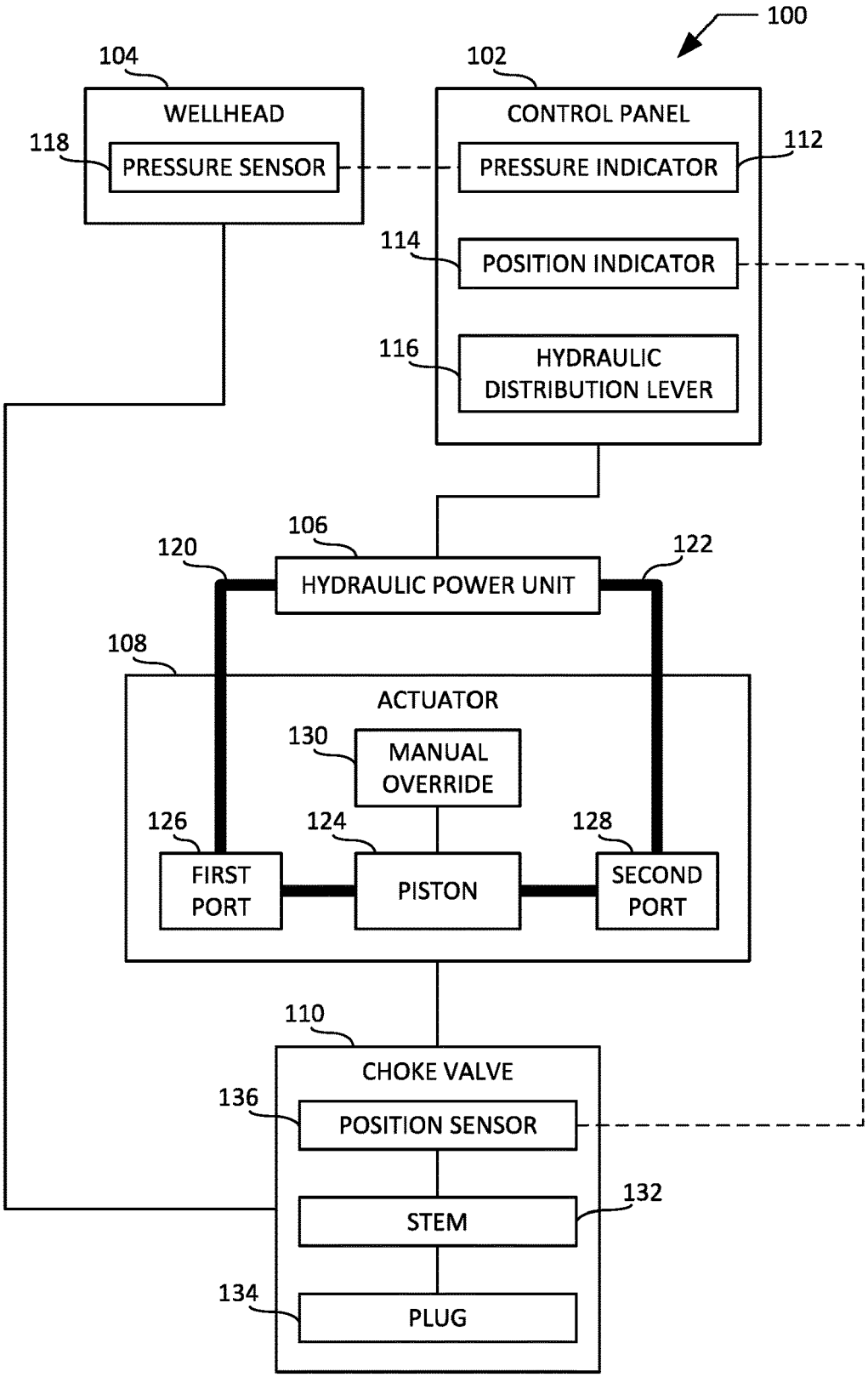
(PRIOR ART) FIG. 1
FIG. 1 is a block diagram of a known choke control system.

FIG. 1 is a block diagram of a known choke control system 100. The choke control system 100 includes a control panel 102, a wellhead 104, a hydraulic power unit 106, an actuator 108 and a choke valve 110. The choke control system 100 manages and/or controls the wellhead pressure (e.g. surface pressure) of a wellhead (e.g., the wellhead 104) operatively coupled to a well (not shown). By managing and/or controlling the wellhead pressure, the choke control system 100 also manages and/or controls the production rate from the well. Management and/or control of the wellhead pressure via the choke control system 100 may prevent kicks and/or blowouts of the well from occurring.

The control panel 102 of FIG. 1 is operatively coupled to the hydraulic power unit 106 to enable a distribution of hydraulic fluid supplied by the hydraulic power unit 106 to be controlled. As described in greater detail herein, the hydraulic power unit 106 is operatively coupled to the actuator 108 of FIG. 1, the actuator 108 is operatively coupled to the choke valve 110 of FIG. 1, and the choke valve 110 is operatively coupled to the wellhead 104 of FIG. 1. Thus, by enabling the distribution of hydraulic fluid supplied by the hydraulic power unit 106 to be controlled, the control panel 102 further enables the choke position of the choke valve 110 and/or the wellhead pressure of the wellhead 104 to be controlled.

The control panel 102 of FIG. 1 is manually monitored and/or manually operated by a human drilling operator. The control panel 102 includes a pressure indicator 112, a position indicator 114 and a hydraulic distribution lever 116. The pressure indicator 112 provides the drilling operator with a visual indication (e.g., via a gauge or other display device) of the wellhead pressure of the wellhead 104 of FIG. 1. The position indicator 114 provides the drilling operator with a visual indication (e.g., via a gauge or other display device) of the choke position (e.g., fifty percent closed) of the choke valve 110 of FIG. 1. The hydraulic distribution lever 116 is movable (e.g., turnable, slidable, etc.) and/or positionable by the drilling operator to adjust the distribution of the hydraulic fluid supplied by the hydraulic power unit 106 of FIG. 1 to the actuator 108 of FIG. 1.

For example, in response to noticing an undesirable wellhead pressure of the wellhead 104 via the pressure indicator 112, and/or in response to noticing an undesirable choke position of the choke valve 110 via the position indicator 114, the drilling operator may move and/or adjust a position of the hydraulic distribution lever 116 in a direction that results in a corresponding movement and/or adjustment to the choke position of the choke valve 110 and/or the wellhead pressure of the wellhead 104. As a result of the drilling operator moving and/or adjusting the position of the hydraulic distribution lever 116, the extent to which the wellhead pressure of the wellhead 104 and/or the choke position of the choke valve 110 deviate from desired value(s) may be reduced for a duration of time (e.g., until the drilling operator notices another undesirable condition of the wellhead pressure of the wellhead 104 and/or the choke position of the choke valve 110 requiring additional manual intervention via the hydraulic distribution lever 116 of the control panel 102).

The wellhead 104 of FIG. 1 provides a structural and pressure-containing interface for drilling and production equipment associated with a well. The wellhead 104 includes a pressure sensor 118. The pressure sensor 118 senses, measures and/or detects a wellhead pressure of the wellhead 104. The pressure sensor 118 of the wellhead 104 is operatively coupled (e.g., via wired and/or wireless communication) to the pressure indicator 112 of the control panel 102 such that the visual indication of the wellhead pressure provided via the pressure indicator 112 corresponds to the wellhead pressure sensed, measured and/or detected via the pressure sensor 118. The wellhead pressure of the wellhead 104 sensed, measured and/or detected via the pressure sensor 118 may increase and/or decrease as a result of a change in a choke position of the choke valve 110.

The hydraulic power unit 106 of FIG. 1 supplies hydraulic fluid to the actuator 108 of FIG. 1 based on the position of the hydraulic distribution lever 116 of the control panel 102 of FIG. 1. For example, in response to a movement and/or adjustment of the hydraulic distribution lever 116 by the drilling operator, the hydraulic power unit 106 adjusts a distribution of the hydraulic fluid being supplied to the actuator 108 via a first hydraulic fluid supply line 120 and/or a second hydraulic fluid supply line 122.

The actuator 108 of FIG. 1 is a double-acting actuator including a piston 124, a first port 126, a second port 128, and a manual override 130. The first port 126 of the actuator 108 is in fluid communication with the hydraulic power unit 106 via the first hydraulic fluid supply line 120. The second port 128 of the actuator 108 is in fluid communication with the hydraulic power unit 106 via the second hydraulic fluid supply line 122. The piston 124 of the actuator 108 is movable and/or positionable based on the distribution of the hydraulic fluid received via the first port 126 and/or the second port 128 of the actuator 108. For example, the piston 124 may move in a first direction in response to an increase of the hydraulic fluid received via the first port 126 relative to the hydraulic fluid received via the second port 128, and may move in a second direction opposite the first direction in response to an increase of the hydraulic fluid received via the second port 128 relative to the hydraulic fluid received via the first port 126. The manual override 130 of the actuator 108 is a manually-operable wheel and/or lever that may be used by a drilling operator to move and/or position the piston 124 of the actuator 108. For example, a drilling operator may need to operate the manual override 130 of the actuator 108 in the absence of hydraulic fluid being adjustably supplied to the actuator 108 via the hydraulic power unit 106.

The choke valve 110 of FIG. 1 controls production flow from the well to which the wellhead 104 of FIG. 1 is operatively coupled. The choke valve 110 includes a stem 132, a plug 134, and a position sensor 136. The stem 132 of the choke valve 110 is rigidly coupled (e.g., directly or indirectly) to the piston 124 of the actuator 108 such that movement of the piston 124 of the actuator 108 produces a corresponding movement of the stem 132 of the choke valve 110. Similarly, the plug 134 of the choke valve 110 is rigidly coupled (e.g., directly or indirectly) to the stem 132 of the choke valve 110 such that movement of the stem 132 of the choke valve 110 produces a corresponding movement of the plug 134 of the choke valve 110.

The position sensor 136 of the choke valve 110 is operatively coupled to the stem 132 of the choke valve 110. The position sensor 136 senses, measures and/or detects a position (e.g., a linear displacement) of the stem 132 of the choke valve 110, and/or a choke position (e.g., an extent to which a flow control member of the choke valve is open and/or closed) of the choke valve 110. For example, the position sensor 136 may sense, measure and/or detect that the stem 132 of the choke valve 110 is in a position corresponding to the choke position of the choke valve 110 being fifty percent closed. The position sensor 136 of the choke valve 110 is operatively coupled (e.g., via wired and/or wireless communication) to the position indicator 114 of the control panel 102 such that the visual indication of the choke position provided via the position indicator 114 corresponds to the position of the stem 132 and/or the choke position of the choke valve 110 sensed, measured and/or detected via the position sensor 136. The choke position of the choke valve 110 sensed, measured and/or detected via the position sensor 136 may increase and/or decrease as a result of a change in the position of the stem 132 and/or the plug 134 of the choke valve 110. Changes to the choke position of the choke valve 110 may produce corresponding increases and/or decreases to the wellhead pressure of the wellhead 104. In contrast to the known choke control system 100 of FIG. 1, the example automated choke control apparatus and methods described herein selectively control the wellhead pressure of the wellhead via a wellhead pressure control loop, or the choke position of the choke valve via a choke position control loop.

Figure 2:
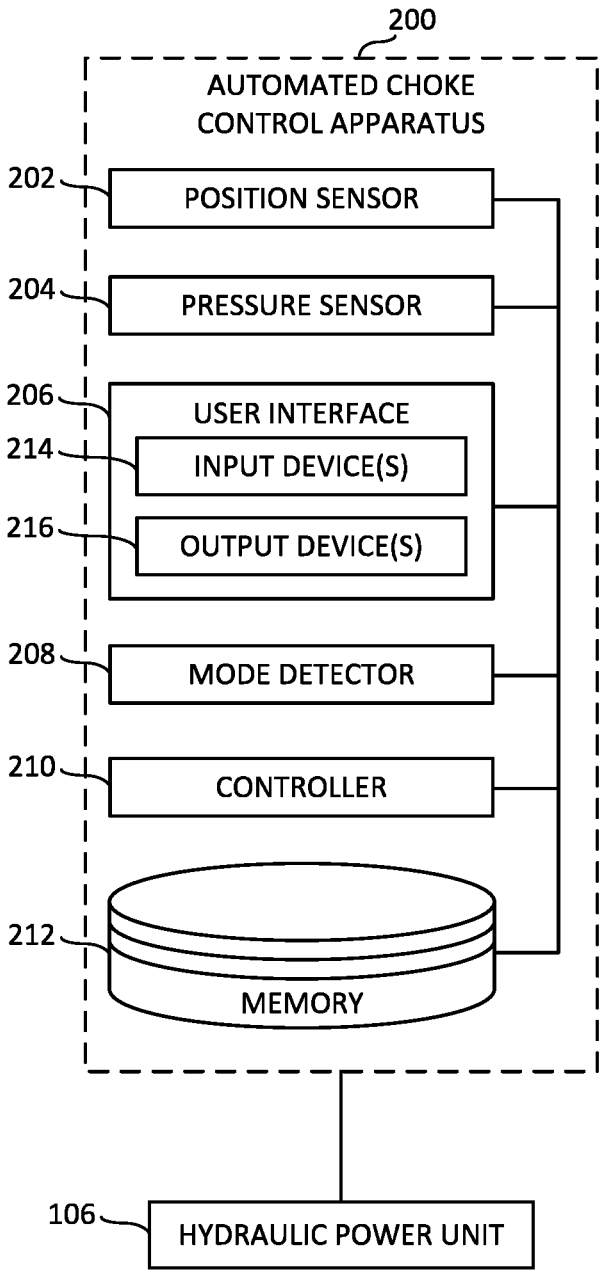
FIG. 2 is a block diagram of an example automated choke control apparatus that may be implemented in accordance with the teachings of this disclosure.

FIG. 2 is a block diagram of an example automated choke control apparatus 200 that may be implemented in accordance with the teachings of this disclosure. As described in greater detail herein, the automated choke control apparatus 200 of FIG. 2 is operatively coupled to one or more structure(s) and/or component(s) of a choke control system (e.g., the known choke control system 100 of FIG. 1). In the illustrated example of FIG. 2, the automated choke control apparatus 200 includes an example position sensor 202, an example pressure sensor 204, an example user interface 206, an example mode detector 208, an example controller 210, and an example memory 212. However, other example implementations of the automated choke control apparatus 200 may include fewer or additional structures in accordance with the teachings of this disclosure.

The example position sensor 202 of FIG. 2 is operatively coupled to a stem of a choke valve (e.g., the stem 132 of the choke valve 110 of FIG. 1). The position sensor 202 of FIG. 2 senses, measures and/or detects a position (e.g., a linear displacement) of the stem of the choke valve, and/or a choke position of the choke valve (e.g., an extent to which a flow control member of the choke valve is open and/or closed). For example, the position sensor 202 may sense, measure and/or detect that the stem of the choke valve is in a position corresponding to the choke valve being fifty percent closed. In the illustrated example of FIG. 2, the position of the stem of the choke valve and/or the choke position of the choke valve sensed, measured and/or detected by the position sensor 202 is provided to and/or made accessible to the controller 210 of FIG. 2. Position data sensed, measured and/or detected by the position sensor 202 may be of any type, form and/or format, and may be stored in a computer-readable storage medium such as the example memory 212 described below.

The example pressure sensor 204 of FIG. 2 is operatively coupled to a wellhead (e.g., the wellhead 104 of FIG. 1). The pressure sensor 204 of FIG. 2 senses, measures and/or detects a wellhead pressure of the wellhead. In the illustrated example of FIG. 2, the wellhead pressure sensed, measured and/or detected by the pressure sensor 204 is provided to and/or made accessible to the controller 210 of FIG. 2. Pressure data sensed, measured and/or detected by the pressure sensor 204 may be of any type, form and/or format, and may be stored in a computer-readable storage medium such as the example memory 212 described below.

The example user interface 206 of FIG. 2 facilitates interactions and/or communications between an end user and the automated choke control apparatus 200 of FIG. 2. The user interface 206 includes one or more input device(s) 214 via which the user may input information and/or data to the controller 210 of the automated choke control apparatus 200. For example, the input device(s) 214 may be implemented as one or more of a button, a switch, a dial, a keyboard, a mouse, and/or a touchscreen that enable(s) the user to convey data and/or commands to the controller 210 of the automated choke control apparatus 200. In some examples, the data and/or command(s) conveyed via the input device(s) 214 of the user interface 206 identify and/or indicate a choke position setpoint and/or a desired choke position of a choke valve (e.g., a desired choke position of the choke valve 110 of FIG. 1). In some examples, the data and/or command(s) conveyed via the input device(s) 214 of the user interface 206 identify and/or indicate a wellhead pressure setpoint and/or a desired wellhead pressure of a wellhead (e.g., a desired wellhead pressure of the wellhead 104 of FIG. 1). In some examples, the data and/or information conveyed via the input device(s) 214 of the user interface 206 identify and/or indicate a selected control mode (e.g., a choke position control mode, a wellhead pressure control mode, a manual override mode, etc.) of the automated choke control apparatus 200 of FIG. 2. Data and/or information that is received and/or conveyed via the user input device(s) 214 of the user interface 206 may be of any type, form and/or format, and may be stored in a computer-readable storage medium such as the example memory 212 described below.

The user interface 206 of FIG. 2 also includes one or more output device(s) 216 via which the controller 210 of the automated choke control apparatus 200 presents information and/or data in visual and/or audible form to the user. For example, the output device(s) 216 may be implemented as one or more of a light emitting diode, a touchscreen, and/or a liquid crystal display for presenting visual information, and/or a speaker for presenting audible information. In some examples, the data and/or information presented via the output device(s) 216 of the user interface 206 identify and/or indicate a measured and/or current choke position of a choke valve (e.g., a current choke position of the choke valve 110 of FIG. 1). In some examples, the data and/or information presented via the output device(s) 216 of the user interface 206 identify and/or indicate a measured and/or current wellhead pressure of a wellhead (e.g., a current wellhead pressure of the wellhead 104 of FIG. 1). In some examples, the data and/or command(s) presented via the output device(s) 216 of the user interface 206 identify and/or indicate a choke position setpoint and/or a desired choke position of a choke valve (e.g., a desired choke position of the choke valve 110 of FIG. 1). In some examples, the data and/or command(s) presented via the output device(s) 216 of the user interface 206 identify and/or indicate a wellhead pressure setpoint and/or a desired wellhead pressure of a wellhead (e.g., a desired wellhead pressure of the wellhead 104 of FIG. 1). In some examples, the data and/or information presented via the output device(s) 216 of the user interface 206 identify and/or indicate a selected control mode (e.g., a choke position control mode, a wellhead pressure control mode, a manual override mode, etc.) of the automated choke control apparatus 200 of FIG. 2. Data and/or information that is presented and/or to be presented via the output device(s) 216 of the user interface 206 may be of any type, form and/or format, and may be stored in a computer-readable storage medium such as the example memory 212 described below.

The example mode detector 208 of FIG. 2 determines, identifies and/or detects an operation mode of the automated choke control apparatus 200 of FIG. 2. For example, the mode detector 208 may identify and/or detect selection of one of a plurality of available operation modes of the automated choke control apparatus 200 including, for example, a choke position control mode, a wellhead pressure control mode, or a manual override mode. In some examples, the mode detector 208 determines and/or detects selection of the choke position control mode, the wellhead pressure control mode, or the manual override mode based on data and/or information (e.g., a mode selection bit, a choke position setpoint, a desired choke position, a wellhead pressure setpoint, a desired wellhead pressure, a manual override code, etc.) included within and/or indicated by an input control signal received via one or more of the input device(s) 214 of the user interface 206 of FIG. 2. Mode identification data determined, identified and/or detected by the pressure sensor 204 may be of any type, form and/or format, and may be stored in a computer-readable storage medium such as the example memory 212 described below.

The example controller 210 of FIG. 2 may be implemented by a semiconductor device such as a processor, microprocessor, or microcontroller. The controller 210 manages and/or controls the operation of the automated choke control apparatus 200 of FIG. 2, a hydraulic power unit (e.g., the hydraulic power unit 106 of FIG. 1) operatively coupled to the automated choke control apparatus 200, an actuator (e.g., the actuator 108 of FIG. 1) operatively coupled to the hydraulic power unit, and/or a choke valve (e.g., the choke valve 110 of FIG. 1) operatively coupled to the actuator. The controller 210 manages and/or controls the automated choke control apparatus 200, the hydraulic power unit, the actuator and/or the choke valve based on data, information and/or one or more signal(s) obtained and/or accessed by the controller 210 from one or more of the position sensor 202, the pressure sensor 204, the user interface 206, the mode detector 208 and/or the memory 212, and/or based on data, information and/or one or more signal(s) provided by the controller 210 to one or more of the user interface 206, the mode detector 208, the memory 212 and/or the hydraulic power unit.

In some examples, the controller 210 of FIG. 2 determines whether an input control signal has been received. For example, the controller 210 may determine that an input control signal has been received via one or more of the input device(s) 214 of the user interface 206 of FIG. 2. In some examples, the controller 210 operates and/or controls a choke position control loop in response to the mode detector 208 of FIG. 2 determining that a received input control signal indicates selection of a choke position control mode of the automated choke control apparatus 200 of FIG. 2. In some examples, the controller 210 continues to operate and/or control the choke position control loop until the controller 210 determines that an updated input control signal has been received indicating selection of a different operation mode (e.g., a wellhead pressure control mode, a manual override mode, etc.) of the automated choke control apparatus 200 of FIG. 2. In some examples, the controller 210 operates and/or controls a wellhead pressure control loop in response to the mode detector 208 of FIG. 2 determining that a received input control signal indicates selection of a wellhead pressure control mode of the automated choke control apparatus 200 of FIG. 2. In some examples, the controller 210 continues to operate and/or control the wellhead pressure control loop until the controller 210 determines that an updated input control signal has been received indicating selection of a different operation mode (e.g., a choke position control mode, a manual override mode, etc.) of the automated choke control apparatus 200 of FIG. 2.

In some examples, the controller 210 of FIG. 2 determines a desired choke position of a choke valve. For example the controller 210 may determine a desired choke position of a choke valve (e.g., the choke valve 110 of FIG. 1) based on an identified choke position setpoint. In some examples, data and/or information identifying and/or indicating the desired choke position (e.g., the choke position setpoint) may be included in an input control signal received via one or more of the input device(s) 214 of the user interface 206 of FIG. 2. In other examples, data and/or information identifying and/or indicating the desired choke position may be received via one or more of the input device(s) 214 of the user interface 206 of FIG. 2 separately from (e.g., prior to or subsequent to) the received input control signal. In some examples, the controller 210 may determine a desired choke position of a choke valve by accessing, obtaining, and/or otherwise identifying desired choke position data (e.g., the choke position setpoint) stored in the example memory 212 of FIG. 2.

In some examples, the controller 210 of FIG. 2 determines a current choke position of a choke valve. For example, the controller 210 may determine a current choke position of a choke valve (e.g., the choke valve 110 of FIG. 1) by accessing, obtaining, and/or otherwise identifying stem position data sensed, measured and/or detected by the example position sensor 202 of FIG. 2, and/or choke position data derived therefrom. In some examples, the controller 210 may determine a current choke position of the choke valve based on choke position correlation data stored in the example memory 212 of FIG. 2. In some such examples, the choke position correlation data enables the controller 210 to associate (e.g., correlate) a position of the stem of the choke valve (e.g., a position of the stem 132 of the choke valve 110 of FIG. 1) with a corresponding choke position (e.g., fifty percent closed) of the choke valve.

In some examples, the controller 210 of FIG. 2 determines a difference between a current choke position of a choke valve and a desired choke position of the choke valve. For example, the controller 210 may determine a difference between a current choke position of a choke valve (e.g., the choke valve 110 of FIG. 1) and the desired choke position of the choke valve by comparing position data corresponding to the current choke position to position data corresponding to the desired choke position. In some examples, the controller 210 determines whether the difference between the current choke position of the choke valve and the desired choke position exceeds a choke position error threshold. For example, the controller 210 may determine that the difference between the current choke position of the choke valve and the desired choke position exceeds a choke position error threshold, thus indicating that the current choke position needs to be adjusted via one or more control signal(s) to match the desired choke position within an acceptable margin of error.

In some examples, the controller 210 of FIG. 2 generates one or more control signal(s) to adjust the current choke position of the choke valve to match the desired choke position. For example, the controller 210 may generate one or more control signal(s) that cause(s) a hydraulic power unit (e.g., the hydraulic power unit 106 of FIGS. 1 and 2) to distribute hydraulic control fluid to an actuator (e.g., the actuator 108 of FIG. 1) operatively coupled to the choke valve such that the actuator causes a stem and/or a plug of the choke valve (e.g., the stem 132 and/or the plug 134 of the choke valve 110 of FIG. 1) to move from a current position corresponding to the current choke position of the choke valve to a desired position corresponding to the desired choke position. In some examples, the one or more control signal(s) generated by the controller 210 and supplied to the hydraulic power unit correspond to a difference between the current choke position of the choke valve and the desired choke position. The one or more control signal(s) generated by the controller 210 and supplied to the hydraulic power unit cause the stem and/or the plug of the choke valve to move in a direction that results in the current choke position of the choke valve being adjusted toward the desired choke position.

In some examples, the controller 210 of FIG. 2 determines a desired wellhead pressure of a wellhead. For example the controller 210 may determine a desired wellhead pressure of a wellhead (e.g., the wellhead 104 of FIG. 1) based on an identified wellhead pressure setpoint. In some examples, data and/or information identifying and/or indicating the desired wellhead pressure (e.g., the wellhead pressure setpoint) may be included in an input control signal received via one or more of the input device(s) 214 of the user interface 206 of FIG. 2. In other examples, data and/or information identifying and/or indicating the desired wellhead pressure may be received via one or more of the input device(s) 214 of the user interface 206 of FIG. 2 separately from (e.g., prior to or subsequent to) the received input control signal. In some examples, the controller 210 may determine a desired wellhead pressure of a wellhead by accessing, obtaining, and/or otherwise identifying desired wellhead pressure data (e.g., the wellhead pressure setpoint) stored in the example memory 212 of FIG. 2.

In some examples, the controller 210 of FIG. 2 determines a current wellhead pressure of a wellhead. For example, the controller 210 may determine a current wellhead pressure of a wellhead (e.g., the wellhead 104 of FIG. 1) by accessing, obtaining, and/or otherwise identifying wellhead pressure data sensed, measured and/or detected by the example pressure sensor 204 of FIG. 2.

In some examples, the controller 210 of FIG. 2 determines a difference between a current wellhead pressure of a wellhead and a desired wellhead pressure of the wellhead. For example, the controller 210 may determine a difference between a current wellhead pressure of a wellhead (e.g., the wellhead 104 of FIG. 1) and a desired wellhead pressure of the wellhead by comparing wellhead pressure data corresponding to the current wellhead pressure to wellhead pressure data corresponding to the desired wellhead pressure. In some examples, the controller 210 of FIG. 2 determines whether the difference between the current wellhead pressure of the wellhead and the desired wellhead pressure exceeds a wellhead pressure error threshold. For example, the controller 210 may determine that the difference between the current wellhead pressure of the wellhead and the desired wellhead pressure exceeds a wellhead pressure error threshold, thus indicating that the current wellhead pressure needs to be adjusted via one or more control signal(s) to match the desired wellhead pressure within an acceptable margin of error.

In some examples, the controller 210 of FIG. 2 generates one or more control signal(s) to adjust the current wellhead pressure of the wellhead to match the desired wellhead pressure. For example, the controller 210 may generate one or more control signal(s) that cause(s) a hydraulic power unit (e.g., the hydraulic power unit 106 of FIGS. 1 and 2) to distribute hydraulic control fluid to an actuator (e.g., the actuator 108 of FIG. 1) operatively coupled to a choke valve (e.g., the choke valve 110 of FIG. 1) such that the actuator causes a stem and/or a plug of the choke valve (e.g., the stem 132 and/or the plug 134 of the choke valve 110 of FIG. 1) to move from a current position corresponding to the current wellhead pressure of the wellhead to a desired position corresponding to the desired wellhead pressure. In some examples, the controller 210 accesses wellhead pressure correlation data stored in the memory 212 of FIG. 2 to associate (e.g. correlate) a position of a stem of a choke valve (e.g., a position of the stem 132 of the choke valve 110 of FIG. 1) to a corresponding wellhead pressure of a wellhead (e.g., a wellhead pressure of the wellhead 104 of FIG. 1). In some examples, the one or more control signal(s) generated by the controller 210 and supplied to the hydraulic power unit correspond to a difference between the current wellhead pressure and the desired wellhead pressure, and/or to a difference between a current position of the stem corresponding to the current wellhead pressure and a desired position of the stem corresponding to the desired wellhead pressure. The one or more control signal(s) generated by the controller 210 and supplied to the hydraulic power unit cause the stem and/or the plug of the choke valve to move in a direction that results in the current wellhead pressure of the wellhead being adjusted toward the desired wellhead pressure.

The example memory 212 of FIG. 2 may be implemented by any type(s) and/or any number(s) of storage device(s) such as a storage drive, a flash memory, a read-only memory (ROM), a random-access memory (RAM), a cache and/or any other storage medium in which information is stored for any duration (e.g., for extended time periods, permanently, brief instances, for temporarily buffering, and/or for caching of the information). The information stored in the memory 212 may be stored in any file and/or data structure format, organization scheme, and/or arrangement. The memory 212 is accessible to the position sensor 202, the pressure sensor 204, the user interface 206, the mode detector 208 and the controller 210 of FIG. 2, and/or, more generally, to the automated choke control apparatus 200 of FIG. 2.

In some examples, the memory 212 of FIG. 2 stores desired choke position data (e.g., a choke position setpoint) derived from one or more signals, messages and/or commands received via the user interface 206 of FIG. 2. In some examples, the memory 212 stores current choke position data (e.g., a measured choke position) sensed, measured and/or detected by the position sensor 202 of FIG. 2. In some examples, the memory 212 stores choke position correlation data that may be accessed to associate (e.g. correlate) a position of a stem of a choke valve (e.g., a position of the stem 132 of the choke valve 110 of FIG. 1) to a corresponding choke position (e.g., fifty percent closed) of the choke valve. In some examples, the memory 212 stores a choke position error threshold.

In some examples, the memory 212 of FIG. 2 stores desired wellhead pressure data (e.g., a wellhead pressure setpoint) derived from one or more signals, messages and/or commands received via the user interface 206 of FIG. 2. In some examples, the memory 212 stores current wellhead pressure data (e.g., a measured wellhead pressure) sensed, measured and/or detected by the pressure sensor 204 of FIG. 2. In some examples, the memory 212 stores wellhead pressure correlation data that may be accessed to associate (e.g. correlate) a position of a stem of a choke valve (e.g., a position of the stem 132 of the choke valve 110 of FIG. 1) to a corresponding wellhead pressure of a wellhead (e.g., a wellhead pressure of the wellhead 104 of FIG. 1). In some examples, the memory 212 stores a wellhead pressure error threshold.

In some examples, the automated choke control apparatus 200 of FIG. 2 implements and/or is operatively coupled to (e.g., in electrical communication with) a supervisor module that monitors (e.g., senses, measures, and/or detects) bottom hole and surface conditions of the well to ensure that the limitations of the drilling equipment are not exceeded. In some such examples, data obtained via the supervisor module may be obtained and analyzed by the automated choke control apparatus 200 of FIG. 2. The automated choke control apparatus 200 of FIG. 2 may control the hydraulic power unit 106 based in part on the data obtained from the supervisor module, thereby ensuring equipment safety while simultaneously providing for automated control of choke position and wellhead pressure.

While an example manner of implementing the example automated choke control apparatus 200 is illustrated in FIG. 2, one or more of the elements, processes and/or devices illustrated in FIG. 2 may be combined, divided, re-arranged, omitted, eliminated and/or implemented in any other way. Further, the example position sensor 202, the example pressure sensor 204, the example user interface 906, the example mode detector 208, the example controller 210 and/or the example memory 214 of FIG. 2 may be implemented by hardware, software, firmware and/or any combination of hardware, software and/or firmware. Thus, for example, any of the example position sensor 202, the example pressure sensor 204, the example user interface 906, the example mode detector 208, the example controller 210 and/or the example memory 214 of FIG. 2 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example position sensor 202, the example pressure sensor 204, the example user interface 906, the example mode detector 208, the example controller 210 and/or the example memory 214 of FIG. 2 is/are hereby expressly defined to include a tangible computer readable storage device or storage disk such as a memory, a digital versatile disk (DVD), a compact disk (CD), a Blu-ray disk, etc. storing the software and/or firmware. Further still, the example automated choke control apparatus 200 of FIG. 2 may include one or more elements, processes and/or devices in addition to, or instead of, those illustrated in FIG. 2, and/or may include more than one of any or all of the illustrated elements, processes and devices.

Figure 3A:
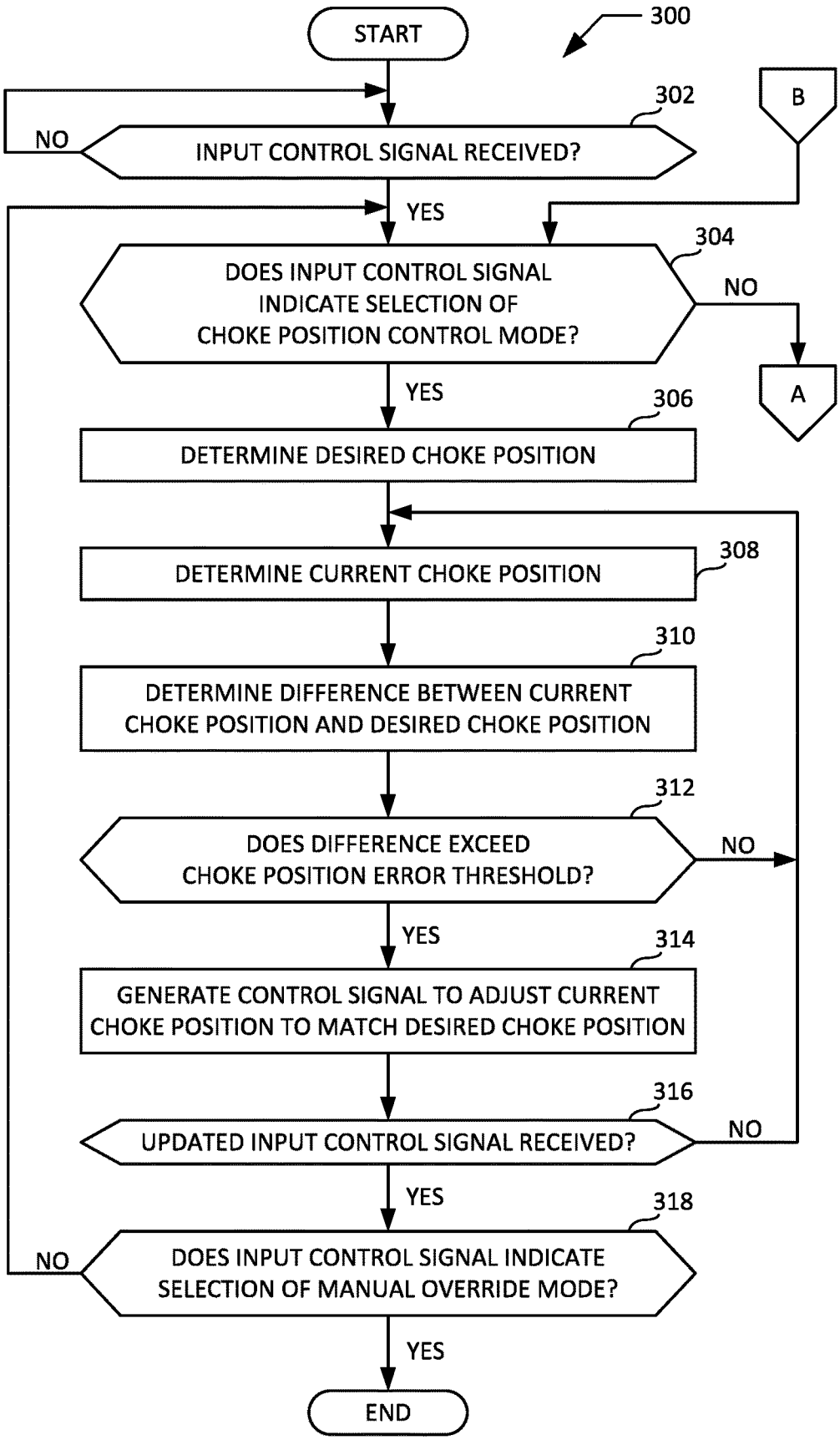
FIGS. 3A and 3B are a flowchart representative of an example method that may be executed at the example automated choke control apparatus of FIG. 2 to selectively control a choke position of a choke valve or a pressure of a wellhead.
Figure 3B:
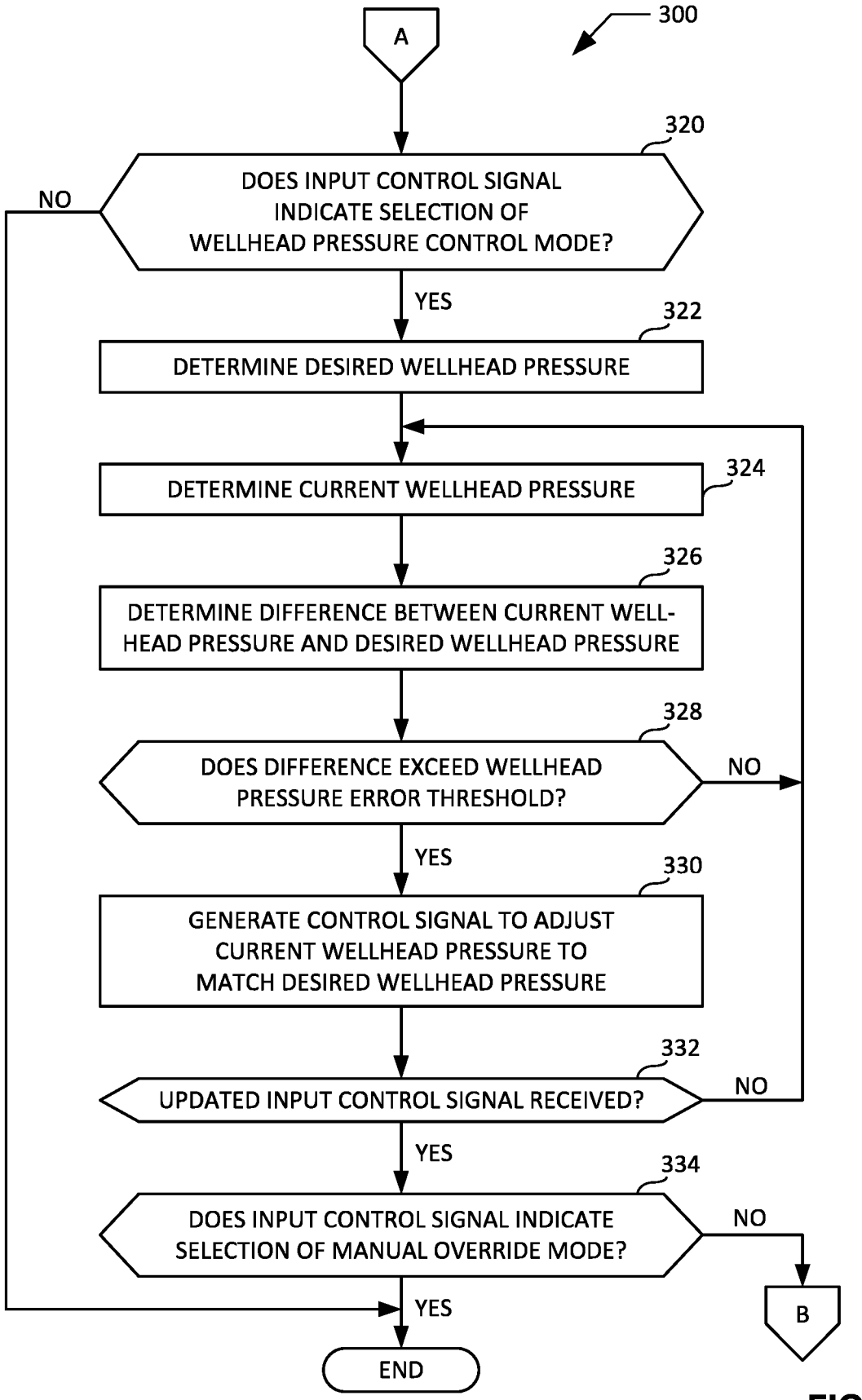

A flowchart representative of an example method that may be executed at the example automated choke control apparatus 200 of FIG. 2 to selectively control a choke position of a choke valve or a wellhead pressure of a wellhead is shown in FIGS. 3A and 3B. In this example, the method may be implemented using machine-readable instructions that comprise one or more program(s) for execution by a processor such as the example processor 402 shown in the example processor platform 400 discussed below in connection with FIG. 4. The one or more program(s) may be embodied in software stored on a tangible computer readable storage medium such as a CD-ROM, a floppy disk, a hard drive, a digital versatile disk (DVD), a Blu-ray disk, or a memory associated with the processor 402, but the entire program(s) and/or parts thereof could alternatively be executed by a device other than the processor 402, and/or embodied in firmware or dedicated hardware. Further, although the example program(s) is/are described with reference to the flowchart illustrated in FIGS. 3A and 3B, many other automated methods for selectively controlling a choke position of a choke valve or a wellhead pressure of a wellhead may be used. For example, the order of execution of the blocks may be changed, and/or some of the blocks described may be changed, eliminated, or combined.

As mentioned above, the example method of FIGS. 3A and 3B may be implemented using coded instructions (e.g., computer and/or machine-readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term "tangible computer readable storage medium" is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example method of FIGS. 3A and 3B may be implemented using coded instructions (e.g., computer and/or machine-readable instructions) stored on a non-transitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term "non-transitory computer readable medium" is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

FIGS. 3A and 3B are a flowchart representative of an example method 300 that may be executed at the example automated choke control apparatus 200 of FIG. 2 to selectively control a choke position of a choke valve or a wellhead pressure of a wellhead. The example method 300 begins when the example controller 210 of FIG. 2 determines whether an input control signal has been received (block 302). For example, the controller 210 may determine that an input control signal has been received via one or more of the input device(s) 214 of the user interface 206 of FIG. 2. If the controller 210 determines at block 302 that an input control signal has not been received, control of the example method 300 remains at block 302. If the controller 210 instead determines at block 302 that an input control signal has been received, control of the example method 300 proceeds to block 304.

At block 304, the example mode detector 208 of FIG. 2 determines whether the input control signal indicates selection of a choke position control mode (block 304). For example, the mode detector 208 may determine that the input control signal detected at block 302 of the method 300 indicates selection of a choke position control mode based on data and/or information (e.g., a mode selection bit, a choke position setpoint, a desired choke position, etc.) included within and/or indicated by the input control signal. If the mode detector 208 determines at block 304 that the input control signal indicates selection of a choke position control mode, control of the example method 300 proceeds to block 306. If the mode detector 208 instead determines at block 304 that the input control signal does not indicate selection of a choke position control mode, control of the example method 300 proceeds to block 320.

At block 306, the example controller 210 of FIG. 2 determines a desired choke position of a choke valve (block 306). For example the controller 210 may determine a desired choke position of a choke valve (e.g., the choke valve 110 of FIG. 1) based on an identified choke position setpoint. In some examples, data and/or information identifying and/or indicating the desired choke position (e.g., the choke position setpoint) may be included in the input control signal detected at block 302 of the method 300. In other examples, data and/or information identifying and/or indicating the desired choke position may be received via one or more of the input device(s) 214 of the user interface 206 of FIG. 2 separately from (e.g., prior to or subsequent to) the input control signal detected at block 302 of the method 300. In some examples, the controller 210 determines a desired choke position of a choke valve by accessing, obtaining, and/or otherwise identifying desired choke position data (e.g., the choke position setpoint) stored in the example memory 212 of FIG. 2. Following block 306, control of the example method 300 proceeds to block 308.

At block 308, the example controller 210 of FIG. 2 determines a current choke position of the choke valve (block 308). For example, the controller 210 may determine a current choke position of the choke valve (e.g., the choke valve 110 of FIG. 1) by accessing, obtaining, and/or otherwise identifying stem position data sensed, measured and/or detected by the example position sensor 202 of FIG. 2, and/or choke position data derived therefrom. In some examples, the controller 210 may determine a current choke position of the choke valve based on choke position correlation data stored in the example memory 212 of FIG. 2. In some such examples, the choke position correlation data enables the controller 210 to associate (e.g., correlate) a position of the stem of the choke valve (e.g., a position of the stem 132 of the choke valve 110 of FIG. 1) with a corresponding choke position (e.g., fifty percent closed) of the choke valve. Following block 308, control of the example method 300 proceeds to block 310.

At block 310, the example controller 210 of FIG. 2 determines a difference between the current choke position and the desired choke position (block 310). For example, the controller 210 may determine a difference between the current choke position and the desired choke position by comparing position data corresponding to the current choke position to position data corresponding to the desired choke position. Following block 310, control of the example method 300 proceeds to block 312.

At block 312, the example controller 210 of FIG. 2 determines whether the difference between the current choke position and the desired choke position exceeds a choke position error threshold (block 312). For example, the controller 210 may determine that the difference between the current choke position and the desired choke position exceeds a choke position error threshold, thus indicating that the current choke position needs to be adjusted via one or more control signal(s) to match the desired choke position within an acceptable margin of error. If the controller 210 determines at block 312 that the difference between the current choke position and the desired choke position does not exceed the choke position error threshold, control of the example method 300 returns to block 308. If the controller 210 instead determines at block 312 that the difference between the current choke position and the desired choke position exceeds the choke position error threshold, control of the example method 300 proceeds to block 314.

At block 314, the example controller 210 of FIG. 2 generates one or more control signal(s) to adjust the current choke position of the choke valve to match the desired choke position (block 314). For example, the controller 210 may generate one or more control signal(s) that cause(s) a hydraulic power unit (e.g., the hydraulic power unit 106 of FIGS. 1 and 2) to distribute hydraulic control fluid to an actuator (e.g., the actuator 108 of FIG. 1) operatively coupled to the choke valve such that the actuator causes a stem and/or a plug of the choke valve (e.g., the stem 132 and/or the plug 134 of the choke valve 110 of FIG. 1) to move from a current position corresponding to the current choke position of the choke valve to a desired position corresponding to the desired choke position. In some examples, the one or more control signal(s) generated by the controller 210 and supplied to the hydraulic power unit correspond to a difference between the current choke position and the desired choke position, and/or to a difference between a current position of the stem corresponding to the current choke position and a desired position of the stem corresponding to the desired choke position. The one or more control signal(s) generated by the controller 210 and supplied to the hydraulic power unit cause the stem and/or the plug of the choke valve to move in a direction that results in the current choke position of the choke valve being adjusted toward the desired choke position. Following block 314, control of the example method 300 proceeds to block 316.

At block 316, the example controller 210 of FIG. 2 determines whether an updated input control signal has been received (block 316). For example, the controller 210 may determine that an updated input control signal (e.g., a more recent input control signal relative to the input control signal detected at block 302 of the method 300) has been received via one or more of the input device(s) 214 of the user interface 206 of FIG. 2. If the controller 210 determines at block 316 that an updated input control signal has not been received, control of the example method 300 returns to block 308. If the controller 210 instead determines at block 316 that an updated input control signal has been received, control of the example method 300 proceeds to block 318.

At block 318, the example mode detector 208 of FIG. 2 determines whether the updated input control signal indicates selection of a manual override mode (block 318). For example, the mode detector 208 may determine that the updated input control signal detected at block 316 of the method 300 indicates selection of a manual override mode based on data and/or information (e.g., a mode selection bit, a manual override code, etc.) included within and/or indicated by the updated input control signal. If the mode detector 208 determines at block 318 that the updated input control signal does not indicate selection of a manual override mode, control of the example method 300 returns to block 304. If the mode detector 208 instead determines at block 318 that the updated input control signal indicates selection of a manual override mode, the example method 300 ends.

At block 320, the example mode detector 208 of FIG. 2 determines whether the input control signal indicates selection of a wellhead pressure control mode (block 320). For example, the mode detector 208 may determine that the input control signal (e.g., the input control signal detected at block 302, the updated input control signal detected at block 316, etc.) indicates selection of a wellhead pressure control mode based on data and/or information (e.g., a mode selection bit, a wellhead pressure setpoint, a desired wellhead pressure, etc.) included within and/or indicated by the input control signal. If the mode detector 208 determines at block 320 that the input control signal indicates selection of a wellhead pressure control mode, control of the example method 300 proceeds to block 322. If the mode detector 208 instead determines at block 320 that the input control signal does not indicate selection of a wellhead pressure control mode, the example method 300 ends.

At block 322, the example controller 210 of FIG. 2 determines a desired wellhead pressure of a wellhead (block 322). For example the controller 210 may determine a desired wellhead pressure of a wellhead (e.g., the wellhead 104 of FIG. 1) based on an identified wellhead pressure setpoint. In some examples, data and/or information identifying and/or indicating the desired wellhead pressure (e.g., the wellhead pressure setpoint) may be included in the input control signal detected at block 302 of the method 300. In other examples, data and/or information identifying and/or indicating the desired wellhead pressure may be received via one or more of the input device(s) 214 of the user interface 206 of FIG. 2 separately from (e.g., prior to or subsequent to) the input control signal detected at block 302 of the method 300. In some examples, the controller 210 determines a desired wellhead pressure of a wellhead by accessing, obtaining, and/or otherwise identifying desired wellhead pressure data (e.g., the wellhead pressure setpoint) stored in the example memory 212 of FIG. 2. Following block 322, control of the example method 300 proceeds to block 324.

At block 324, the example controller 210 of FIG. 2 determines a current wellhead pressure of the wellhead (block 324). For example, the controller 210 may determine a current wellhead pressure of the wellhead (e.g., the wellhead 104 of FIG. 1) by accessing, obtaining, and/or otherwise identifying wellhead pressure data sensed, measured and/or detected by the example pressure sensor 204 of FIG. 2. Following block 324, control of the example method 300 proceeds to block 326.

At block 326, the example controller 210 of FIG. 2 determines a difference between the current wellhead pressure and the desired wellhead pressure (block 326). For example, the controller 210 may determine a difference between the current wellhead pressure and the desired wellhead pressure by comparing wellhead pressure data corresponding to the current wellhead pressure to wellhead pressure data corresponding to the desired wellhead pressure. Following block 326, control of the example method 300 proceeds to block 328.

At block 328, the example controller 210 of FIG. 2 determines whether the difference between the current wellhead pressure and the desired wellhead pressure exceeds a wellhead pressure error threshold (block 328). For example, the controller 210 may determine that the difference between the current wellhead pressure and the desired wellhead pressure exceeds a wellhead pressure error threshold, thus indicating that the current wellhead pressure needs to be adjusted via one or more control signal(s) to match the desired wellhead pressure within an acceptable margin of error. If the controller 210 determines at block 328 that the difference between the current wellhead pressure and the desired wellhead pressure does not exceed the wellhead pressure error threshold, control of the example method 300 returns to block 324. If the controller 210 instead determines at block 328 that the difference between the current wellhead pressure and the desired wellhead pressure exceeds the wellhead pressure error threshold, control of the example method 300 proceeds to block 330.

At block 330, the example controller 210 of FIG. 2 generates one or more control signal(s) to adjust the current wellhead pressure of the wellhead to match the desired wellhead pressure (block 330). For example, the controller 210 may generate one or more control signal(s) that cause(s) a hydraulic power unit (e.g., the hydraulic power unit 106 of FIGS. 1 and 2) to distribute hydraulic control fluid to an actuator (e.g., the actuator 108 of FIG. 1) operatively coupled to a choke valve (e.g., the choke valve 110 of FIG. 1) such that the actuator causes a stem and/or a plug of the choke valve (e.g., the stem 132 and/or the plug 134 of the choke valve 110 of FIG. 1) to move from a current position corresponding to the current wellhead pressure of the wellhead to a desired position corresponding to the desired wellhead pressure. In some examples, the controller 210 accesses wellhead pressure correlation data stored in the memory 212 of FIG. 2 to associate (e.g. correlate) a position of a stem of a choke valve (e.g., a position of the stem 132 of the choke valve 110 of FIG. 1) to a corresponding wellhead pressure of a wellhead (e.g., a wellhead pressure of the wellhead 104 of FIG. 1). In some examples, the one or more control signal(s) generated by the controller 210 and supplied to the hydraulic power unit correspond to a difference between the current wellhead pressure and the desired wellhead pressure, and/or to a difference between a current position of the stem corresponding to the current wellhead pressure and a desired position of the stem corresponding to the desired wellhead pressure. The one or more control signal(s) generated by the controller 210 and supplied to the hydraulic power unit cause the stem and/or the plug of the choke valve to move in a direction that results in the current wellhead pressure of the wellhead being adjusted toward the desired wellhead pressure. Following block 330, control of the example method 300 proceeds to block 332.

At block 332, the example controller 210 of FIG. 2 determines whether an updated input control signal has been received (block 332). For example, the controller 210 may determine that an updated input control signal (e.g., a more recent input control signal relative to the input control signal detected at block 302 of the method 300) has been received via one or more of the input device(s) 214 of the user interface 206 of FIG. 2. If the controller 210 determines at block 332 that an updated input control signal has not been received, control of the example method 300 returns to block 324. If the controller 210 instead determines at block 332 that an updated input control signal has been received, control of the example method 300 proceeds to block 334.

At block 334, the example mode detector 208 of FIG. 2 determines whether the updated input control signal indicates selection of a manual override mode (block 334). For example, the mode detector 208 may determine that the updated input control signal detected at block 332 of the method 300 indicates selection of a manual override mode based on data and/or information (e.g., a mode selection bit) included within and/or indicated by the updated input control signal. If the mode detector 208 determines at block 334 that the updated input control signal does not indicate selection of a manual override mode, control of the example method 300 returns to block 304. If the mode detector 208 instead determines at block 334 that the updated input control signal indicates selection of a manual override mode, the example method 300 ends.

Figure 4:
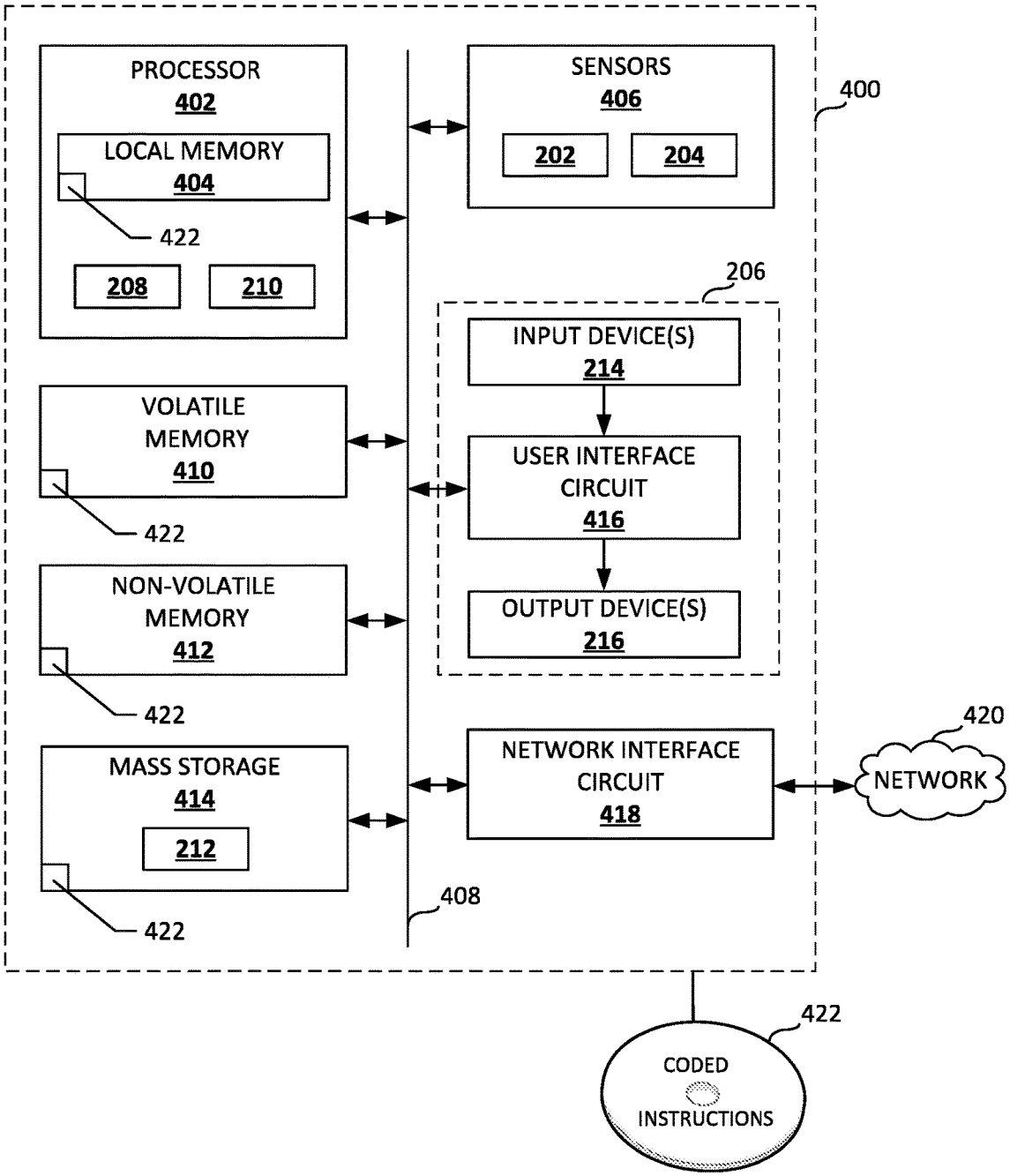
FIG. 4 is an example processor platform capable of executing instructions to implement the method of FIGS. 3A and 3B and the example automated choke control apparatus of FIG. 2.

FIG. 4 is an example processor platform 400 capable of executing instructions to implement the example method 300 of FIGS. 3A and 3B and the example automated choke control apparatus 200 of FIG. 2. The processor platform 400 of the illustrated example includes a processor 402. The processor 402 of the illustrated example is hardware. For example, the processor 402 can be implemented by one or more integrated circuit(s), logic circuit(s), microprocessor(s) or controller(s) from any desired family or manufacturer. The processor 402 of the illustrated example includes a local memory 404 (e.g., a cache). The processor 402 also includes the example mode detector 208 and the example controller 210 of FIG. 2.

The processor 402 of the illustrated example is in communication with one or more example sensors 406 via a bus 408. The example sensors 406 include the example position sensor 202 and the example pressure sensor 204 of FIG. 2.

The processor 402 of the illustrated example is also in communication with a main memory including a volatile memory 410 and a non-volatile memory 412 via the bus 408. The volatile memory 410 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 412 may be implemented by flash memory and/or any other desired type of memory device. Access to the volatile memory 410 and the non-volatile memory 412 is controlled by a memory controller.

The processor 402 of the illustrated example is also in communication with one or more mass storage devices 414 for storing software and/or data. Examples of such mass storage devices 414 include floppy disk drives, hard drive disks, compact disk drives, Blu-ray disk drives, RAID systems, and digital versatile disk (DVD) drives. In the illustrated example, the mass storage device 414 includes the example memory 212 of FIG. 2.

The processor platform 400 of the illustrated example also includes a user interface circuit 416. The user interface circuit 416 may be implemented by any type of interface standard, such as an Ethernet interface, a universal serial bus (USB), and/or a PCI express interface. In the illustrated example, one or more input device(s) 214 are connected to the user interface circuit 416. The input device(s) 214 permit(s) a user to enter data and commands into the processor 402. The input device(s) 214 can be implemented by, for example, a button, a switch, a dial, a keyboard, a mouse, a touchscreen, an audio sensor, a camera (still or video), a track-pad, a trackball, isopoint, a voice recognition system, a microphone, and/or a liquid crystal display. One or more output device(s) 216 are also connected to the user interface circuit 416 of the illustrated example. The output device(s) 216 can be implemented, for example, by a light emitting diode, an organic light emitting diode, a liquid crystal display, a touchscreen and/or a speaker. The user interface circuit 416 of the illustrated example may, thus, include a graphics driver such as a graphics driver chip and/or processor. In the illustrated example, the input device(s) 214, the output device(s) 216 and the user interface circuit 416 collectively form the example user interface 206 of FIG. 2.

The processor platform 400 of the illustrated example also includes a network interface circuit 418. The network interface circuit 418 may be implemented by any type of interface standard, such as an Ethernet interface, a universal serial bus (USB), and/or a PCI express interface. In the illustrated example, the network interface circuit 418 facilitates the exchange of data and/or signals with external machines via a network 420. In some examples, the network 420 may be facilitated via 4-20 mA wiring and/or via one or more communication protocol(s) including, for example, Foundation Fieldbus, Highway Addressable Remote Transducer (HART), Transmission Control Protocol/Internet Protocol (TCP/IP), Profinet, Modbus and/or Ethernet.

Coded instructions 422 for implementing the method 300 of FIGS. 3A and 3B may be stored in the local memory 404, in the volatile memory 410, in the non-volatile memory 412, in the mass storage device 414, and/or on a removable tangible computer readable storage medium such as a CD or DVD.

From the foregoing, it will be appreciated that the disclosed automated choke control apparatus and methods provide numerous advantages over conventional choke control systems. For example, implementation of the disclosed automated choke control apparatus and methods provide for selective control of the wellhead pressure of the wellhead via a wellhead pressure control loop, or the choke position of the choke valve via a choke position control loop. Accordingly, implementation of the disclosed automated choke control apparatus and methods advantageously reduces the extent of human intervention needed to maintain a wellhead pressure of a wellhead and/or a choke position of a choke valve at desirable value(s). Reducing the extent of human intervention reduces the possibility of human exposure to a well scenario (e.g., a blowout) and also reduces operational risks associated with human errors.

The aforementioned advantages and/or benefits are achieved via the disclosed automated choke control apparatus and methods. In some examples, an apparatus for automatically controlling a choke valve is disclosed. In some disclosed examples, the apparatus comprises a controller. In some disclosed examples, the controller is to control a choke position of the choke valve via a first control loop in response to selection of a first one of a plurality of operation modes being detected. In some disclosed examples, the controller is to control a wellhead pressure of a wellhead via a second control loop in response to selection of a second one of the plurality of operation modes being detected. In some disclosed examples, the wellhead is operatively coupled to the choke valve.

In some disclosed examples of the apparatus, the controller, while controlling the choke position of the choke valve via the first control loop, is to determine a desired choke position of the choke valve and to determine a current choke position of the choke valve. In some disclosed examples of the apparatus, the controller, while controlling the choke position of the choke valve via the first control loop, is further to generate a control signal in response to determining that a difference between the current choke position and the desired choke position exceeds a choke position error threshold. In some disclosed examples, the generated control signal is to cause a hydraulic power unit and an actuator operatively coupled to the choke valve to adjust the current choke position of the choke valve to match the desired choke position.

In some disclosed examples of the apparatus, the controller, while controlling the wellhead pressure of the wellhead via the second control loop, is to determine a desired wellhead pressure of the wellhead and to determine a current wellhead pressure of the wellhead. In some disclosed examples of the apparatus, the controller, while controlling the wellhead pressure of the wellhead via the second control loop, is further to generate a control signal in response to determining that a difference between the current wellhead pressure and the desired wellhead pressure exceeds a wellhead pressure error threshold. In some disclosed examples, the generated control signal is to cause a hydraulic power unit and an actuator operatively coupled to the choke valve to adjust the current wellhead pressure of the wellhead to match the desired wellhead pressure by adjusting a current choke position of the choke valve.

In some disclosed examples of the apparatus, the controller is further to control the choke position of the choke valve via the first control loop until selection of the second one of the plurality of operation modes or selection of a third one of the plurality of operation modes is detected. In some disclosed examples of the apparatus, the controller is further to control the wellhead pressure of the wellhead via the second control loop until selection of the first one of the plurality of operation modes or selection of the third one of the plurality of operation modes is detected. In some disclosed examples, the third one of the plurality of operation modes is a manual override mode.

In some disclosed examples, the apparatus further comprises a user interface to receive input control signals associated with automatically controlling the choke valve. In some disclosed examples, the apparatus further comprises a mode detector to detect selection of respective ones of the first one, the second one, and the third one of the plurality of operation modes based on mode identification data included in corresponding ones of the input control signals received via the user interface. In some disclosed examples, the mode identification data includes at least one of a mode selection bit, a choke position setpoint, a wellhead pressure setpoint, or a manual override code.

In some examples, a method for automatically controlling a choke valve is disclosed. In some disclosed examples, the method comprises controlling a choke position of the choke valve via a first control loop in response to selection of a first one of a plurality of operation modes being detected. In some disclosed examples, the method comprises controlling a wellhead pressure of a wellhead via a second control loop in response to selection of a second one of the plurality of operation modes being detected. In some disclosed examples, the wellhead is operatively coupled to the choke valve.

In some disclosed examples of the method, controlling the choke position of the choke valve via the first control loop comprises determining a desired choke position of the choke valve and determining a current choke position of the choke valve. In some disclosed examples of the method, controlling the choke position of the choke valve via the first control loop further comprises generating a control signal in response to determining that a difference between the current choke position and the desired choke position exceeds a choke position error threshold. In some disclosed examples, the generated control signal is to cause a hydraulic power unit and an actuator operatively coupled to the choke valve to adjust the current choke position of the choke valve to match the desired choke position.

In some disclosed examples of the method, controlling the wellhead pressure of the wellhead via the second control loop comprises determining a desired wellhead pressure of the wellhead and determining a current wellhead pressure of the wellhead. In some disclosed examples of the method, controlling the wellhead pressure of the wellhead via the second control loop comprises generating a control signal in response to determining that a difference between the current wellhead pressure and the desired wellhead pressure exceeds a wellhead pressure error threshold. In some disclosed examples, the generated control signal is to cause a hydraulic power unit and an actuator operatively coupled to the choke valve to adjust the current wellhead pressure of the wellhead to match the desired wellhead pressure by adjusting a current choke position of the choke valve.

In some disclosed examples, the method further comprises controlling the choke position of the choke valve via the first control loop until selection of the second one of the plurality of operation modes or selection of a third one of the plurality of operation modes is detected. In some disclosed examples, the method further comprises controlling the wellhead pressure of the wellhead via the second control loop until selection of the first one of the plurality of operation modes or selection of the third one of the plurality of operation modes is detected. In some disclosed examples, the third one of the plurality of operation modes is a manual override mode.

In some disclosed examples, the method further comprises receiving, via a user interface, input control signals associated with automatically controlling the choke valve. In some disclosed examples, the method further comprises detecting selection of respective ones of the first one, the second one, and the third one of the plurality of operation modes based on mode identification data included in corresponding ones of the input control signals received via the user interface. In some disclosed examples, the mode identification data includes at least one of a mode selection bit, a choke position setpoint, a wellhead pressure setpoint, or a manual override code.

In some examples, a tangible machine readable storage medium comprising instructions is disclosed. In some disclosed examples, the instructions, when executed, cause a controller to control a choke position of a choke valve via a first control loop in response to selection of a first one of a plurality of operation modes being detected. In some disclosed examples, the instructions, when executed, cause the controller to control a wellhead pressure of a wellhead via a second control loop in response to selection of a second one of the plurality of operation modes being detected. In some disclosed examples, the wellhead is operatively coupled to the choke valve.

In some disclosed examples of the tangible machine readable storage medium, the instructions, when executed, cause the controller controlling the choke position of the choke valve via the first control loop to determine a desired choke position of the choke valve and determining a current choke position of the choke valve. In some disclosed examples of the tangible machine readable storage medium, the instructions, when executed, cause the controller controlling the choke position of the choke valve via the first control loop to generate a control signal in response to determining that a difference between the current choke position and the desired choke position exceeds a choke position error threshold. In some disclosed examples, the generated control signal is to cause a hydraulic power unit and an actuator operatively coupled to the choke valve to adjust the current choke position of the choke valve to match the desired choke position.

In some disclosed examples of the tangible machine readable storage medium, the instructions, when executed, cause the controller controlling the wellhead pressure of the wellhead via the second control loop to determine a desired wellhead pressure of the wellhead and determining a current wellhead pressure of the wellhead. In some disclosed examples of the tangible machine readable storage medium, the instructions, when executed, cause the controller controlling the wellhead pressure of the wellhead via the second control loop to generate a control signal in response to determining that a difference between the current wellhead pressure and the desired wellhead pressure exceeds a wellhead pressure error threshold. In some disclosed examples, the generated control signal is to cause a hydraulic power unit and an actuator operatively coupled to the choke valve to adjust the current wellhead pressure of the wellhead to match the desired wellhead pressure by adjusting a current choke position of the choke valve.

In some disclosed examples of the tangible machine readable storage medium, the instructions, when executed, cause the controller to control the choke position of the choke valve via the first control loop until selection of the second one of the plurality of operation modes or selection of a third one of the plurality of operation modes is detected. In some disclosed examples of the tangible machine readable storage medium, the instructions, when executed, cause the controller to control the wellhead pressure of the wellhead via the second control loop until selection of the first one of the plurality of operation modes or selection of the third one of the plurality of operation modes is detected. In some disclosed examples, the third one of the plurality of operation modes is a manual override mode.

In some disclosed examples of the tangible machine readable storage medium, the instructions, when executed, cause the controller to detect selection of respective ones of the first one, the second one, and the third one of the plurality of operation modes based on mode identification data included in corresponding ones of input control signals received via a user interface. In some disclosed examples, the corresponding ones of the input control signals are associated with automatically controlling the choke valve. In some disclosed examples, the mode identification data includes at least one of a mode selection bit, a choke position setpoint, a wellhead pressure setpoint, or a manual override code.

In some disclosed examples, the choke may be used as a drilling choke by linking it to wellhead sensors at the same time as a testing choke for use during a well testing operation. The choke provides an accurate choke size with various methods to measure the size of the choke.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. An apparatus for automatically controlling a choke valve, the apparatus comprising:

a controller to:

control a choke position of the choke valve via a first control loop in response to selection of a first one of a plurality of operation modes being detected; and control a wellhead pressure of a wellhead via a second control loop in response to selection of a second one of the plurality of operation modes being detected, the wellhead operatively coupled to the choke valve.

2. The apparatus of claim 1, wherein the controller, while controlling the choke position of the choke valve via the first control loop, is to:

determine a desired choke position of the choke valve;

determine a current choke position of the choke valve; and generate a control signal in response to determining that a difference between the current choke position and the desired choke position exceeds a choke position error threshold, the control signal to cause a hydraulic power unit and an actuator operatively coupled to the choke valve to adjust the current choke position of the choke valve to match the desired choke position.

3. The apparatus of claim 1, wherein the controller, while controlling the wellhead pressure of the wellhead via the second control loop, is to:

determine a desired wellhead pressure of the wellhead;

determine a current wellhead pressure of the wellhead; and generate a control signal in response to determining that a difference between the current wellhead pressure and the desired wellhead pressure exceeds a wellhead pressure error threshold, the control signal to cause a hydraulic power unit and an actuator operatively coupled to the choke valve to adjust the current wellhead pressure of the wellhead to match the desired wellhead pressure by adjusting a current choke position of the choke valve.

4. The apparatus of claim 1, wherein the controller is further to:

control the choke position of the choke valve via the first control loop until selection of the second one of the plurality of operation modes or selection of a third one of the plurality of operation modes is detected; and control the wellhead pressure of the wellhead via the second control loop until selection of the first one of the plurality of operation modes or selection of the third one of the plurality of operation modes is detected.

5. The apparatus of claim 4, wherein the third one of the plurality of operation modes is a manual override mode.

6. The apparatus of claim 4, further comprising:

a user interface to receive input control signals associated with automatically controlling the choke valve; and a mode detector to detect selection of respective ones of the first one, the second one, and the third one of the plurality of operation modes based on mode identification data included in corresponding ones of the input control signals received via the user interface.

7. The apparatus of claim 6, wherein the mode identification data includes at least one of a mode selection bit, a choke position setpoint, a wellhead pressure setpoint, or a manual override code.

8. A method for automatically controlling a choke valve, the method comprising:

controlling a choke position of the choke valve via a first control loop in response to selection of a first one of a plurality of operation modes being detected; and controlling a wellhead pressure of a wellhead via a second control loop in response to selection of a second one of the plurality of operation modes being detected, the wellhead operatively coupled to the choke valve.

9. The method of claim 8, wherein controlling the choke position of the choke valve via the first control loop comprises:

determining a desired choke position of the choke valve;

determining a current choke position of the choke valve; and generating a control signal in response to determining that a difference between the current choke position and the desired choke position exceeds a choke position error threshold, the control signal to cause a hydraulic power unit and an actuator operatively coupled to the choke valve to adjust the current choke position of the choke valve to match the desired choke position.

10. The method of claim 8, wherein controlling the wellhead pressure of the wellhead via the second control loop comprises:

determining a desired wellhead pressure of the wellhead;

determining a current wellhead pressure of the wellhead; and generating a control signal in response to determining that a difference between the current wellhead pressure and the desired wellhead pressure exceeds a wellhead pressure error threshold, the control signal to cause a hydraulic power unit and an actuator operatively coupled to the choke valve to adjust the current wellhead pressure of the wellhead to match the desired wellhead pressure by adjusting a current choke position of the choke valve.

11. The method of claim 8, further comprising:

controlling the choke position of the choke valve via the first control loop until selection of the second one of the plurality of operation modes or selection of a third one of the plurality of operation modes is detected; and controlling the wellhead pressure of the wellhead via the second control loop until selection of the first one of the plurality of operation modes or selection of the third one of the plurality of operation modes is detected.

12. The method of claim 11, wherein the third one of the plurality of operation modes is a manual override mode.

13. The method of claim 11, further comprising:

receiving, via a user interface, input control signals associated with automatically controlling the choke valve; and detecting selection of respective ones of the first one, the second one, and the third one of the plurality of operation modes based on mode identification data included in corresponding ones of the input control signals received via the user interface.

14. The method of claim 13, wherein the mode identification data includes at least one of a mode selection bit, a choke position setpoint, a wellhead pressure setpoint, or a manual override code.

15. A tangible machine readable storage medium comprising instructions that, when executed, cause a controller to at least:

control a choke position of a choke valve via a first control loop in response to selection of a first one of a plurality of operation modes being detected; and control a wellhead pressure of a wellhead via a second control loop in response to selection of a second one of the plurality of operation modes being detected, the wellhead operatively coupled to the choke valve.

16. The tangible machine readable storage medium of claim 15, wherein the instructions, when executed, are further to cause the controller controlling the choke position of the choke valve via the first control loop to:

determine a desired choke position of the choke valve;

determine a current choke position of the choke valve; and generate a control signal in response to determining that a difference between the current choke position and the desired choke position exceeds a choke position error threshold, the control signal to cause a hydraulic power unit and an actuator operatively coupled to the choke valve to adjust the current choke position of the choke valve to match the desired choke position.

17. The tangible machine readable storage medium of claim 15, wherein the instructions, when executed, are further to cause the controller controlling the wellhead pressure of the wellhead via the second control loop to:

determine a desired wellhead pressure of the wellhead;

determine a current wellhead pressure of the wellhead; and generate a control signal in response to determining that a difference between the current wellhead pressure and the desired wellhead pressure exceeds a wellhead pressure error threshold, the control signal to cause a hydraulic power unit and an actuator operatively coupled to the choke valve to adjust the current wellhead pressure of the wellhead to match the desired wellhead pressure by adjusting a current choke position of the choke valve.

18. The tangible machine readable storage medium of claim 15, wherein the instructions, when executed, are further to cause the controller to:

control the choke position of the choke valve via the first control loop until selection of the second one of the plurality of operation modes or selection of a third one of the plurality of operation modes is detected; and control the wellhead pressure of the wellhead via the second control loop until selection of the first one of the plurality of operation modes or selection of the third one of the plurality of operation modes is detected, the third one of the plurality of operation modes being a manual override mode.

19. The tangible machine readable storage medium of claim 18, wherein the instructions, when executed, are further to cause the controller to:

detect selection of respective ones of the first one, the second one, and the third one of the plurality of operation modes based on mode identification data included in corresponding ones of input control signals received via a user interface, the corresponding ones of the input control signals being associated with automatically controlling the choke valve.

20. The tangible machine readable storage medium of claim 19, wherein the mode identification data includes at least one of a mode selection bit, a choke position setpoint, a wellhead pressure setpoint, or a manual override code.

* * * * *